United States Patent [19]

Ackelson et al.

[11] Patent Number: 4,695,365

[45] Date of Patent: Sep. 22, 1987

[54] HYDROCARBON REFINING PROCESS

[75] Inventors: Donald B. Ackelson, Costa Mesa; Eric L. Moorehead, Diamond Bar; John W. Ward, Yorba Linda; Jon D. Probst, Fullerton, all of Calif.

[73] Assignee: Union Oil Company of California, Los Angeles, Calif.

[21] Appl. No.: 891,735

[22] Filed: Jul. 31, 1986

[51] Int. Cl.[4] ..... C109 65/04

[52] U.S. Cl. ..... 208/89; 208/15; 208/27; 208/92; 208/97; 208/111

[58] Field of Search ..... 208/89, 97, 58, 18, 208/111, 143, 254 H, 217, 251 H, 15, 27, 92

[56] References Cited

U.S. PATENT DOCUMENTS

| | | | |
|---|---|---|---|
| Re. 28,398 | 4/1975 | Chen et al. | 208/111 |
| 3,303,128 | 2/1967 | Peel et al. | 208/27 |
| 3,338,819 | 8/1967 | Wood | 208/97 |
| 3,486,993 | 12/1969 | Egan et al. | 208/89 |
| 3,487,005 | 12/1969 | Egan et al. | 208/89 |
| 3,575,843 | 4/1971 | Aitken et al. | 208/15 |
| 3,767,564 | 10/1973 | Youngblood et al. | 208/15 |
| 3,880,746 | 4/1975 | Bennett et al. | 208/18 |
| 4,028,224 | 6/1977 | MacDonald et al. | 208/92 |
| 4,067,797 | 1/1978 | Chen et al. | 208/15 |
| 4,100,056 | 7/1978 | Reynolds | 208/92 |
| 4,153,540 | 5/1979 | Gorring et al. | 208/89 |
| 4,181,598 | 1/1980 | Gillespie et al. | 208/58 |
| 4,347,121 | 8/1982 | Mayer et al. | 208/58 |
| 4,414,097 | 11/1983 | Chester et al. | 258/18 |
| 4,428,825 | 1/1984 | Ward et al. | 208/109 |
| 4,428,862 | 1/1984 | Ward et al. | 502/77 |
| 4,436,614 | 3/1984 | Olbrich et al. | 208/58 |
| 4,500,424 | 2/1985 | Simpson et al. | 208/216 PP |
| 4,600,497 | 7/1986 | Ward et al. | 208/89 |

OTHER PUBLICATIONS

Publication entitled "Shape Selective Catalysis in Zeolites" by Csicsery, Chemistry in Britain, May, 1985.

U.S. patent application Ser. No. 867,768 filed May 28, 1986, by Moorehead et al.

U.S. patent application Ser. No. 779,939 filed Sep. 25, 1985, by Moorehead et al.

U.S. patent application Ser. No. 856,817 filed Apr. 24, 1986, by Ward et al.

*Primary Examiner*—Andrew H. Metz

*Assistant Examiner*—Anthony McFarlane

*Attorney, Agent, or Firm*—Dean Sandford; Gregory F. Wirzbicki

[57] ABSTRACT

A spindle oil is hydrotreated and then hydrodewaxed in the presence of a catalyst containing at least 70 percent by weight of an intermediate pore molecular sieve in the support so as to produce a selected fraction having a low pour point and viscosity comparable to the original spindle oil, said fraction being then suitable as a "cutter stock" for lowering the pour point of fuel oils.

116 Claims, No Drawings

HYDROCARBON REFINING PROCESS

BACKGROUND OF THE INVENTION

This invention relates to the refining of spindle oils, and particularly to the hydroprocessing of spindle oils.

Spindle oils are relatively high boiling fractions of crude oils and the like and are comparable to heavy atmospheric gas oils. The typical spindle oil boils in the range of about 500° to 950° F. (260° to 510° C.), with the initial boiling point usually being in the range of 500° to 600° F. (260° to 316° C.) and the end point in the range of 850° to 950° F. (454° to 510° C.).

In some instances, it is desirable in a refinery to reduce the pour point of a spindle oil without decreasing its viscosity. For example, if it is desired to reduce the pour point of a fuel oil without affecting its viscosity, one possible method is to use a spindle oil of comparable viscosity but of reduced pour point as a "cutter stock". Unfortunately, most spindle oils themselves have a relatively high pour point, and, if such oils are refined to reduce the pour point, there is a danger that the viscosity will be reduced as well.

It is a specific object of the invention to provide a process for treating a spindle oil for pour point reduction with minimum degradation of the viscosity to provide a blending stock for fuel oils. It is yet another object of the invention to achieve the foregoing while also reducing the nitrogen and sulfur contents of the spindle oil.

SUMMARY OF THE INVENTION

The present invention is directed to upgrading spindle oils by a catalytic refining method in which the spindle oil is substantially reduced in pour point and the viscosity does not undergo substantial degradation, i.e., the viscosity remains high. This is achieved by first contacting the spindle oil with a hydrotreating catalyst under conditions of elevated temperature and pressure and the presence of hydrogen to remove nitrogen and then contacting a portion or all of the effluent with a hydrodewaxing catalyst under conditions of elevated temperature and pressure and the presence of hydrogen so as to produce a fraction, e.g., a 180° C.+ (356° F.+) fraction, of low pour point but of viscosity close to that of the original spindle oil feed. Optionally but preferably, the entire hydrodewaxed product is subjected to hydrotreating a relatively high space velocity to remove any mercaptans which may have formed in the presence of the hydrodewaxing catalyst.

In the invention, the hydrotreating catalysts may be any composition known for catalytically promoting hydrotreating reactions, such catalysts usually comprising Group VIB and Group VIII non-noble metal components on a porous refractory oxide support such as alumina. The hydrodewaxing catalyst, however, comprises one or more hydrogenation components, usually selected from the group consisting of the Group VIB metal components and Group VIII noble and non-noble metal components, on a support comprising at least 70 weight percent of an intermediate pore molecular sieve such as silicalite or ZSM-5 zeolite and the balance a porous refractory oxide such as alumina.

DETAILED DESCRIPTION OF THE INVENTION

In the present invention, spindle oils are upgraded by a catalytic treatment to reduce its pour point without degrading the viscosity. The product obtained comprises a hydrocarbon fraction, such as a 180° C.+ (356° F.+) fraction, which is highly useful as a "cutter stock" for high boiling fuel oils, i.e., as a blending stock to reduce the pour point of fuel oils typically boiling completely above 650° F. (343° C.) while not effecting significant decreases in the viscosity of the fuel oil.

The typical spindle oil for treatment in the invention has a boiling point in the range of about 500° to 600° F. (260° to 316° C.) and an end point in the range of about 850° to 950° F. (454° to 510° C.). Typical spindle oils usually have a fairly high pour point, e.g., usually about 50° F. (10° C.) or above, often above 75° F. (23.9° C.), as well as a high nitrogen content, above about 500 wppm (part per million by weight), and sulfur content, above about 0.7 weight percent, often above 1.0 weight percent. Preferred spindle oils are straight run feeds or cuts, especially feeds which have not been previously hydroprocessed. The primary reason for this is that previously hydroprocessed feeds are generally more difficult to treat, requiring, for example, as much as a 20° F. (11.1° C.) higher hydrodewaxing operating temperature than is the case for comparably boiling straight run stocks.

Although the spindle oil could be dewaxed and thus reduced in pour point by direct treatment with the hereinafter described hydrodewaxing catalyst, the present invention first employs a hydrotreating catalyst to remove a substantial proportion of the organonitrogen and organosulfur components. The primary reason for this is that hydrotreating converts the organonitrogen components to ammonia, and ammonia has much less of a detrimental impact on the downstream hydrodewaxing catalyst than organonitrogen components. Organosulfur compounds may also have a detrimental effect on the hydrodewaxing catalyst but to a much less extent. Thus, in the preferred operation, the hydrotreating step is conducted under conditions to yield a desired low nitrogen content, but in so doing, a low sulfur product is also provided.

To achieve the desired low nitrogen content, along with a significant reduction in the sulfur content, the spindle oil feed is contacted with the hydrotreating catalyst at a liquid hourly space velocity usually between about 0.3 and 10.0, preferably between about 0.5 and 2.0, a hydrogen partial pressure usually above about 750 p.s.i.g. (52.0 atm.), preferably between about 800 and 2,500 p.s.i.g (55.4 and 171.1 atm.), a temperature above about 500° F. (260°C.), preferably between about 650° and 780° F. (343° and 416° C.), and a recycle gas rate above about 500 scf/bbl (89.06 scc./ml.), preferably between about 4,000 and 7,000 scf/bbl (712.44 and 1246.77 scc./ml.)

After hydrotreating, the effluent may be sent to a gas/liquid separator to remove the ammonia and hydrogen sulfide produced by the denitrogenation and desulfurization reactions occurring in the hydrotreating stage. Preferably, however, the entire effluent from the hydrotreating stage is passed to the hydrodewaxing stage. This may be accomplished by using two reactors in series, one for hydrotreating, the other for hydrodewaxing, or by simply using a single reactor in which the feed is first passed through the hydrotreating catalyst bed and then through the hydrodewaxing catalyst bed.

Just as the conditions in the hydrotreating stage are adjusted and correlated to achieve a desired nitrogen level in the hydrotreated product, the conditions in the hydrodewaxing stage are adjusted to achieve a desired pour point in the final product or a selected fraction thereof. In the preferred embodiment, the 180° C.+ (356° F.+) fraction is the selected fraction, and the conditions are adjusted and correlated to produce a pour point of −4° F. (−20° C.). The selected fraction usually comprises more than 65 weight percent of the final product, and oftentimes more than 70 or 75 percent by weight of the final product. The usual and preferred hydrodewaxing conditions are: typical space velocity 0.1 to 10, preferred 0.5 to 2.0, typical hydrogen partial pressure, above 750 p.s.i.g (52.0 atm.), preferred from 800 to 2,500 p.s.i.g. (55.4 to 171.1 atm.), a typical temperature above about 500°F. (260° C.), preferred from 650° to 780° F. (343 to 416° C.) and a typical recycle gas rate above 500 scf/bbl (89.06 scc./ml.), preferably from 4,000 to 7,000 scf/bbl (712.44 to 1246.77 scc./ml.). It should be noted that, in addition to promoting hydrogenation reactions needed for hydrodewaxing and the resultant lowering of the pour point, the hydrogenation components in the hydrodewaxing catalyst help to further reduce the nitrogen and sulfur values of the spindle oil feedstock.

In the preferred embodiment, the lower portion of the catalyst in the hydrodewaxing stage is a post-treat bed of hydrotreating catalyst. The conditions maintained in this bed are the same as that in the hydrodewaxing catalyst bed, except that the space velocity is usually higher, on the order of 5 to 20 v/v/hr, preferably about 10.0 v/v/hr. The hydrotreating catalyst in the post-treat bed may be any hydrotreating catalyst known in the art, but is preferably the same as the catalyst in the hydrotreating stage, and even more preferably is the preferred hydrotreating catalyst described hereinbefore. The purpose of this post-treat bed is to saturate olefins and to "scavenge" any mercaptans which may have been produced in the presence of the upstream catalysts, although it is far more likely that any mercaptans which formed did so in the presence of the hydrodewaxing catalyst.

In the preferred embodiment, the object of the foregoing catalytic treatments is to provide a low pour point, low sulfur, low nitrogen "cutter stock" fraction for fuel oils while also minimizing any degradation of the viscosity. (In the present invention, a minimizing of viscosity degradation is achieved when the viscosity of the 180° C.+ (356° F.+) fraction of the spindle oil has a viscosity measured in centistokes at 100° C. (212° F.) differing from the feed entering the hydrotreating stage by no more than 1.75 centistokes. Preferably, however, the viscosity should differ by no more than 1.5 centistokes at 100° C. (212° F.), and even more preferably, by no more than 0.5 centistokes.) In addition, it is highly preferred that the desired fraction have a bromine number no higher than 2.5 grams per 100 grams of sample and have good color stability properties. (In the invention, color stability is measured by testing the product fraction by ASTM method D 1500 for color, then running an accelerated aging test according to ASTM method D 2274, and then testing the aged sample by ASTM method D 1500 once again, with good color stability being indicated by a change of no more than 1 unit in the values derived before and after the aging test.)

As will be seen from the foregoing paragraph, the preferred embodiment of the invention seeks to achieve several objectives at once, and as a result, it will be understood that, with different feedstocks, the attainment of these objectives will require adjustment of operating conditions, particularly in the hydrotreating stage, and in some cases, it may be necessary to sacrifice one or two objectives for the sake of the remainder. Nevertheless, it has been found, for the typical straight run spindle oil, that all the foregoing objects can be met without resort to excessively high temperature operation. That is, good color stability, minimum viscosity degradation, and acceptable bromine number have been attained in the 180° C.+ (356° F. +) fraction by adjusting the temperature in the hydrotreating stage to attain about 50 ppmw of nitrogen in the hydrotreated effluent. And as an added benefit, the simultaneous removal of more than 97 percent, even more than 99 percent, of the sulfur components in the spindle oil has also been achieved (based on the final hydrodewaxed or hydrodewaxed-post treated product in comparison to the hydrotreater feed). As to feedstocks more difficult to treat than typical straight run feedstocks, such as a spindle oil-vacuum gas oil blend, it may well be the case, in order to achieve the majority of the objectives outlined above—and particularly a minimization of viscosity degradation—that a higher nitrogen level must be tolerated in the hydrotreater effluent. In fact, for most such stocks, all of the above objectives can usually be achieved by adjusting the hydrotreater temperature to yield a relatively constant nitrogen value above 50 wppm, for example, between about 90 and 115 wppm, in the hydrotreater effluent.

One or more of the fractions recovered from the hydrodewaxing stage are useful either as a fuel itself or, as is preferred, as a "cutter stock" for fuel oils, that is, as a blending agent to lower the pour point of the fuel oil, for example, from a value in the range of about 20° to 95° F. (−6.67° to 35° C.) to a desired lower value, for example, about 0° to 15° F. (−17.8° to −9.44° C.) while effecting minimal changes in the viscosity of the fuel oil. In other words, in the preferred embodiment, the 180° C. + (356° F. +) fraction will, in addition to having a −4° F. (−20° F.) pour point, also have a viscosity so compatible with a typical fuel oil, e.g., a 650° F.+ (353° C.+) fuel oil, that the fraction is an ideal "cutter stock" for reducing the pour point (and nitrogen and sulfur) of the fuel oil without detrimentally affecting its desired viscosity properties.

In the hydrotreating stage of the process described above, any hydrotreating catalyst known in the art may be employed. Generally, these catalysts comprise one or more hydrogenation components, typically a combination of a Group VIB metal component and a Group VIII metal component (usually a non-noble Group VIII metal component) on an amorphous, porous refractory oxide support. Such supports include alumina, silica, silica-alumina, silica-titania, silica-zirconia, beryllia, chromia, magnesia, thoria, zirconia-titania, and silica-zirconia-titania, but the most preferred refractory oxides are those which are essentially non-cracking, such as alumina, with alumina being most preferred. Preferably, the hydrotreating catalyst contains niclel and/or cobalt component(s) as the Group VIII metal component and molybdenum and/or tungsten component(s) as the Group VIB metal component. In addition, the catalyst may also contain other components, such as phosphorus, and usually the catalyst is activated by sulfiding prior to use or in situ. Usually, the hydrotreating catalyst contains the Group VIII metal component in a proportion between about 0.5 and 15 weight percent, preferably between about 1 and 5 weight percent, calculated as the metal monoxide. The Group VIB metal components are usually contained in a proportion between about 5 and 40 weight percent, and preferably between about 15 and 30 weight percent, calculated as the metal trioxide. Phosphorus, if present, is usually contained in a proportion between about 2 and 6 weight percent, calculated as the element. The typical and preferred hydrotreating catalyst has a surface area of at least 100 $m^2/gm$, preferably at least 125 $m^2/gm$, and most preferably above 150 $m^2/gm$. In the most preferred embodiment, the catalyst has a mode pore diameter between about 75 and 90 angstroms (7.5 and 9.0 nm.) and a pore size distribution wherein at least 70 percent of the pore volume is in pores of diameter in the range from about 20 angstroms (2 nm.) below to 20 angstroms (2 nm.) above the mode pore diameter. (The mode pore diameter is a term of art referring to the point on a plot of cumulative pore volume versus pore diameter that corresponds to the highest value of delta volume divided by delta diameter. For the most preferred hydrotreating catalyst disclosed in Example I hereinafter, the mode pore diameter is essentially equal to the average pore diameter.) In addition, the catalyst is usually of particulate shape, such as 1/16 inch (1.59 mm) diameter cylinders of length between $\frac{1}{8}$ and $\frac{3}{4}$ inch (3.18 and 1.91 mm). More preferably, the hydrotreating catalyst has a shape of a three leaf clover, as described more fully and shown in FIGS. 8 and 8A of U.S. Pat. No. 4,028,227, and most preferably of all, the catalyst is of quadralobal shape, i.e., the catalyst is in the form of particles having a cross-sectional shape of four lobes, emanating from a point where two axes meet at right angles, with the lobes on only one axis being equal to each other and with the quadralobe being symmetrical about the axis of the unequal lobes. Usually, this quadralobal catalyst has a maximum cross-sectional length of about 1/20 inch (1.27 mm).

The hydrodewaxing catalyst comprises one or more hydrogenation components, such as the Group VIB and VIII metal components, with the Group VIB and non-noble Group VIII metals in combination being preferred, on a support comprising at least 70 percent by weight of an intermediate pore molecular sieve and the balance comprising a porous, inorganic refractory oxide. The hydrodewaxing catalyst is typically of a composition as described for the hydrotreating catalyst except that the support contains a dewaxing component, and more specifically still, an intermediate pore, crystalline molecular sieve. Because of the presence of the molecular sieve in the hydrodewaxing catalyst, its physical characteristics—particularly its pore size distribution and surface area—will change dramatically, indeed, even by an order of magnitude. In addition, the presence of a typical crystalline intermediate pore molecular sieve in the hydrodewaxing catalyst will produce a higher surface area and a much larger percentage of the pores in relatively small pores than is the case for the typical hydrotreating catalyst.

As used herein, an "intermediate pore" material refers to those substances containing a substantial number of pores in the range of about 5 to about 7 angstroms (0.5 to 0.7 nm.). The term "molecular sieve" as used herein refers to any material capable of separating atoms or molecules based on their respective dimensions. The preferred molecular sieve is a crystalline material, and even more preferably, a crystalline material of relatively uniform pore size. The term "pore size" as used herein refers to the diameter of the largest molecule that can be sorbed by the particular molecular sieve in question. The measurement of such diameters and pore sizes is discussed more fully in Chapter 8 of the book entitled "Zeolite Molecular Sieves" written by D. W. Breck and published by John Wiley & Sons in 1974, the disclosure of which book is hereby incorporated by reference in its entirely.

The intermediate pore crystalline molecular sieve which forms one of the components of the preferred hydrodewaxing catalyst may be zeolitic or non-zeolitic, has activity for catalytic cracking of hydrocarbons, and has a pore size between about 5.0 and about 7.0 angstroms (0.5 and 0.7 nm.), with the pore openings usually being defined by 10-membered rings of oxygen atoms. The preferred intermediate pore molecular sieve selectively sorbs n-hexane over 2,2-dimethyl-butane. The term "zeolitic" as used herein refers to molecular sieves whose frameworks are formed of substantially only silica and alumina tetrahedra, such as the framework present in ZSM-5 type zeolites. The term "nonzeolitic" as used herein refers to molecular sieves whose frameworks are not formed of substantially only silica and alumina tetrahedra. Examples of nonzeolitic crystalline molecular sieves which may be used as the intermediate pore molecular sieve include crystalline silicas, silicates (other than aluminosilicates), silicoaluminophosphates, chromosilicates, aluminophosphates, titanium aluminosilicates, titanium aluminophosphates, ferrosilicates, gallosilicates, and borosilicates, provided, of course, that the particular material chosen has a pore size between about 5.0 and about 7.0 angstroms (0.5 and 0.7 nm.). A more detailed description of silicoaluminophosphates, titanium aluminophosphates, and the like, which are suitable as intermediate pore molecular sieves for use in the invention, are disclosed more fully in U.S. patent application Ser. No. 768,487 filed on Aug. 22, 1985 in the name of John W. Ward, which application is herein incorporated by reference in its entirety.

The most suitable zeolites for use as the intermediate pore molecular sieve in the preferred hydrodewaxing catalyst are the crystalline aluminosilicate zeolites of the ZSM-5 type, such as ZSM-5, ZSM-11, ZSM-12, ZSM-23, ZSM-35, ZSM-38, and the like, with ZSM-5 being preferred. ZSM-5 is known zeolite and is more fully described in U.S. Pat. No. 3,702,886 herein incorporated by reference in its entirety; ZSM-11 is a known zeolite and is more fully described in U.S. Pat. No. 3,709,979, herein incorporated by reference in its entirety; ZSM-12 is a known zeolite and is more fully described in U.S. Pat. No. 3,832,449, herein incorporated by reference in its entirety; ZSM-23 is a known zeolite and is more fully described in U.S. Pat. No. 4,076,842, herein incorporated by reference in its entirety; ZSM-35 is known zeolite and is more fully described in U.S. Pat. No. 4,016,245, herein incorporated by reference in its entirety; and ZSM-38 is a known zeolite and is more fully described in U.S. Pat. No. 4,046,859, herein incorporated by reference in its entirety. These zeolites are known to readily adsorb benzene and normal paraffins, such as n-hexane, and also certain mono-branched paraffins, such as isopentane, but to have difficulty absorbing di-branched paraffins, such as 2,2-dimethylbutane, and polyalkylaromatics, such as meta-xylene. These zeolites are also known to have a crystal density not less than 1.6 grams per cubic centimeter, a silica-to-alumina ratio of at least 12, and a constraint index, as defined in U.S. Pat. No. 4,229,282, incorporated by reference herein in its entirety, within the range of 1 to 12. The foregoing zeolites are also known to have an effective pore diameter greater than 5 angstroms (0.5 nm.) and to have pores defined by 10-membered rings of oxygen atoms, as explained in U.S. Pat. No. 4,247,388, herein incorporated by reference in its entirety. Such zeolites are preferably utilized in the acid form, as by replacing at least some of the metals contained in the ion exchange sites of the zeolite with hydrogen ions. This exchange may be accomplished directly with an acid or indirectly by ion exchange with ammonium ions followed by calcination to convert the ammonium ions to hydrogen ions. In either case, it is preferred that the exchange be such that a substantial proportion of the ion exchange sites utilized in the catalyst support be occupied with hydrogen ions.

The most preferred intermediate pore crystalline molecular sieve that may be used as a component of the preferred hydrodewaxing catalyst is a crystalline silica molecular sieve essentially free of aluminum and other Group IIIA metals. (By "essentially free of Group IIIA metals" it is meant that the crystalline silica contains less than 0.75 percent by weight of such metals in total, as calculated as the trioxides thereof, e.g., $Al_2O_3$.) The preferred crystalline silica molecular sieve is a silica polymorph, such as the material described in U.S. Pat. No. 4,073,685. One highly preferred silica polymorph is known as silicalite and may be prepared by methods described in U.S. Pat. No. 4,061,724, the disclosure of which is hereby incorporated by reference in its entirety. Another form of silicalite, known as silicalite-2, is disclosed in "Silicalite-2, a Silica Analogue of the Aluminosilicate Zeolite ZSM-11" by Bibby et al., *Nature,* Vol. 280, pp. 664–5, Aug 23, 1979, herein incorporated by reference in its entirety. Silicalite does not share the zeolitic property of substantial ion exchange common to crystalline aluminosilicates and therefore contains essentially no zeolitic metal cations. Unlike the "ZSM family" of zeolites, silicalite is not an aluminosilicate and contains only trace proportions of alumina derived from reagent impurities. Some extremely pure silicalites (and other microporous crystalline silicas) contain less than about 100 ppmw of Group IIIA metals, and yet others less than 50 ppmw, calculated as the trioxides.

The preferred hydrodewaxing catalyst chosen for use in the invention contains a hydrogenation component in addition to one or more of the foregoing described intermediate pore molecular sieves. Typically, the hydrogenation component comprises a Group VIB metal component, and preferably both a Group VIB metal component and a Group VIII metal component are present in the catalyst, with the usual and preferred proportions thereof being as specified hereinbefore with respect to the hydrotreating catalyst. Also included in such a catalyst, at least in the preferred embodiment, is a porous refractory oxide, such as alumina, which is mixed with the intermediate pore molecular sieve to provide a support for the active hydrogenation metals. The preferred catalyst contains cobalt and/or nickel components as the Group VIII metal component and molybdenum and/or tungsten as the Group VIB metal component on a support comprising alumina and either ZSM-5 and/or silicalite as the intermediate pore molecular sieve. The most preferred catalyst, usually having a surface area above about 200 $m^2/gm$, is a sulfided catalyst containing nickel components and tungsten components on a support comprising silicalite or ZSM-5 and alumina, with silicalite being the most preferred of all.

Hydrodewaxing catalysts comprising Group VIB and VIII metal components on a support comprising silicalite are disclosed in U.S. Pat. No. 4,428,862 herein incorporated by reference in its entirety. Likewise, hydrodewaxing catalysts comprising Group VI and VIII metal components on a support comprising ZSM-5 zeolite are disclosed in U.S. Pat. No. 4,600,497, also incorporated by reference in its entirety. In both these patents, the main utility disclosed for such catalysts is for hydrodewaxing shale oils, and in the most highly preferred embodiment of these disclosed catalysts, the catalyst support contains 30 percent by weight of the dewaxing component, i.e., silicalite or ZSM-5. However, in the present invention, it has been found that such catalysts are decidedly inferior for treating spindle oils, having poor activity for producing a 180° C.+ (356° F.+) fraction having a −4° F. (−20° C.) pour point from a spindle oil. As a result to achieve the desired results, such severe conditions (e.g., high temperature) must be used that not only is the energy input requirement excessive (to maintain the severe conditions) but the viscosity is significantly affected, making the resultant 180° C.+ (356° F.+) fraction less useful as a fuel oil "cutter stock". In addition, operating under severe conditions generally leads to unacceptable catalyst deactivation rates and expensive metallurgical requirement for safe, high temperature operation. In the present invention, however, these problems are overcome, for it has been found by substantially increasing the dewaxing component in the support of these catalysts—to values above about 70 weight percent—that not only is the catalyst highly active for hydrodewaxing spindle oils, but, contrary to what one might expect, the pour point is substantially decreased with only minimal changes in viscosity. Thus, in the present invention, it is a critical feature to employ hydrodewaxing catalysts having at least about 70 percent by weight, and preferably between about 75 and 90 percent by weight, and most preferably 80 percent by weight, of the support composed of the intermediate pore molecular sieve, with silicalite and ZSM-5 being preferred, and silicalite being most preferred. The advantages of such catalysts will now be shown in the following examples, which are not provided to limit the invention defined in the claims but to illustrate the performance of embodiments thereof.

EXAMPLE I

A hydrotreated spindle oil feedstock has the properties shown in the following Table I:

TABLE I

Composition and Properties of a Blend of Two Spindle Oils and a Vacuum Gas Oil

| | | | |
|---|---|---|---|
| Universal Mass Analysis | | | |
| Wt. % Paraffins | 26.2 | Wt. % Mono-Naphthenes | 15.8 |
| Wt. % Poly-Naphthenes | 15.5 | Wt. % Mono-Aromatics | 25.4 |
| Wt. % Di-Aromatics | 10.1 | Wt. % Tri-Aromatics | 3.1 |
| Wt. % Tetra-Aromatics | 0.1 | Wt. % Penta-Aromatics | 0.3 |
| ppm Ovalenes | 239 | ppm Coronenes | 739 |
| Density, g/cc @ 15° C. | 0.89 | Distillation, D-1160, °C. (°F.) | |
| Pour Point, | | IPB/5 | 305/360 (581/680) |
| °C. | 30 | 10/20 | 371/381 (700/718) |
| °F. | 86 | 30/40 | 389/396 (732/745) |
| Viscosity, cst | | 50/60 | 404/413 (759/775) |
| @ 50° C. (122° F.) | 14.73 | 70/80 | 424/436 (795/817) |
| @ 100° C. (212° F.) | 4.13 | 90/95 | 458/473 (856/883) |
| Sulfur, ppm | 750 | Max/Rec | 525/98.8 (977/98.8) |
| Total Nitrogen, kjel, ppm | 720 | | |

TABLE I-continued

| Composition and Properties of a Blend of Two Spindle Oils and a Vacuum Gas Oil | |
|---|---|
| Basic Nitrogen, ppm | 115 |
| Wt. % Carbon | 86.2 |
| Wt. % Hydrogen | 13.7 |
| Color | |
| pre ASTM D2274 | 7.5 |
| post ASTM D2274 | 7.5 |

The foregoing feedstock is then processed through a single reactor containing three catalyst beds in series. The first catalyst contains about 4.0 wt. % nickel components calculated as NiO, about 24 wt. % molybdenum components calculated as $MoO_3$, and about 4 wt. % phosphorus components, calculated as P, on an alumina support having a surface area of about 165 m2/gm, a mode pore diameter between about 75 and 90 angstroms (7.5 and 9.0 nm.), and a pore size distribution wherein at least about 70 percent of the pore volume is in pores of diameter between about 20 angstroms (0.2 nm.) below and 20 angstroms (0.2 nm) above the mode pore diameter. The second catalyst, a hydrodewaxing catalyst, is a sulfided, particulate catalyst comprising about 2 weight percent nickel components, calculated as NiO, and 22 weight percent of tungsten components, calculated as $WO_3$, on a support consisting essentially of 30 percent by weight silicalite and 70 percent by weight of alumina and Catapal® alumina binder. The hydrodewaxing catalyst had a cylindrical shape and a cross-sectional diameter of 1/16 inch (1.59 mm). The third catalyst was a second (or post-treat) bed of hydrotreating catalyst of the same composition as used in the first bed. The operating conditions used in the experiment were as follows: 930 p.s.i.a.(63.3 atm.) hydrogen partial pressure, 5,000 scf/bbl (890.55 scc./ml.) gas recycle rate, and a liquid hourly space velocity of 1.75 in the first bed, 1.17 in the second bed, and 10.1 in the third bed. Since the hydrogen purity in the recycle gas was about 97 percent, the total pressure in the system was about 970 p.s.i.a. (66.0 atm.). The temperature was then adjusted to yield a 180° C.+ (356° F.+) product having a pour point of −20° C. (−4° F.).

The foregoing experiment was then repeated, except that the second catalyst contained 80 wt. % silicalite in the support. A comparison was then made between the results of the two experiments, and six significant findings were made:

(1) The start of run temperature to achieve the desired product was 748° F. (398° C.) for the second run using the catalyst containing 80 weight percent of silicalite in the support whereas that for the first run using the catalyst containing only 30 weight percent silicalite in the catalyst support was 766° F. (408° C.)—indicative of a greatly superior 18° F. (10° C.) better activity for the catalyst of the second run.

(2) The second run produced a yield of about 76 percent by weight of the desired 356° F.+ (180° C.+) product. This represented an increase of between about 2 and 3 percent by weight over the yield obtained in the first run.

(3) Although both runs produced products of acceptable color stability, the second run yielded a product which changed by no more than 0.5 unit according to the method of ASTM 1500 before and after the test described in ASTM D 2274 whereas the first run changed by 0.75 to 1.0 unit, on the threshold of the maximum. In addition, the color of the product of the second run was better, being yellow to light orange as opposed to orange to orange-brown in the first run.

(4) The viscosity of the desired 356° F.+(180° C.+) product in the second run showed little change from the original. Specifically, in the second run, the viscosity was reduced to a value of about 3.89 centistokes at 100° C. (212° F.) from the original value of about 4.13 centistokes. In contrast, in the first run, the viscosity was lowered to about 3.1 centistokes, which, although still acceptable, is not as desired a result as that obtained in the first run.

(5) The total sulfur in the product of the second run was about 17 wppm, with less than 5 ppm being present as mercaptan sulfur. In addition, the nitrogen value (total) was about 112 wppm, with only about 7 wppm present as basic nitrogen. Further still, the bromine number of the product of the second run was less than 1 gram per 100 gram of sample. In contrast, in the first run, the bromine number was less than 1 gram per 100 gram of sample, i.e., between 0.7 and 0.9 gram per gram of sample, the sulfur content of the product was about 8 to 10 ppmw, and the nitrogen content of the product was about 30 ppmw. These results show that both runs performed acceptably as to the sulfur, nitrogen, and bromine numbers of the 180° C.+ (356° F.+) product, with the first run yielding slightly better results due to the more severe operating conditions.

(6) Perhaps most important of all, data obtained in the first run showed that almost immediate and noticeable deactivation of the catalysts was taking place, whereas the second run showed no such deactivation.

EXAMPLE II

The two catalyst system described for the second run of Example I was tested in series to treat a spindle oil for 38 days and then a blend of the same spindle oil with a vacuum gas oil, the blend containing 90 volume percent of the spindle oil and 10 volume percent of the vacuum gas oil. The properties and characteristics of these two feedstocks are summarized in the following Table II:

TABLE II

| | Spindle Oil | Spindle Oil VGO Blend |
|---|---|---|
| Gravity, °API | 24.7 | 24.2 |
| ASTM D-1160 Dist. °F. (°C.) | | |
| IBP/5 | 532/623 (278/328) | 517/664 (269/351) |
| 10/20 | 712/751 (378/400) | 706/756 (374/402) |
| 30/40 | 770/785 (410/418) | 771/789 (411/421) |
| 50/60 | 797/808 (425/431) | 803/819 (428/437) |
| 70/80 | 823/843 (439/451) | 830/859 (443/459) |
| 90/95 | 876/910 (469/488) | 894/923 (479/495) |
| Max./Rec. | 921/98.3 (494/98.3) | 963/98.0 (517/98.0) |
| Sulfur, x-ray, wt. % | 1.60[1] | 1.63 |
| Nitrogen, Kjel, ppm | 915[1] | 1030 |
| Hydrogen, wt % | 12.58[1] | 12.56[1] |
| Pour Point, | | |
| °F. | +86 | +88 |
| °C. | +30.0 | +31.1 |
| Viscosity, cst @ 100° C. (212° F.) | 4.96 | 5.20 |
| Asphaltenes, wt. % | 0.3 | 0.1 |

[1]These data an average of values derived from two samples.

The foregoing feedstocks, which were straight run feeds, i.e., non-hydrotreated, were successively run feeds, i.e., non-hydrotreated, were successively passed through two reactors, the first containing the hydrotreating catalyst described in Example I and the second the hydrodewaxing catalyst described for the second run of Example I followed by a post-treat bed of the same catalyst as in the first reactor. The conditions of operation were as follows: 943 p.s.i.a. (64.1 atm.) hydrogen partial pressure, 4,980 scf/bbl (887.0 scc./ml.) of recycle gas, total pressure of 1314 p.s.i.g. (90.4 atm.) and a liquid hourly space velocity in the first reactor of 1.52 and, in the second, 1.02 for the hydrodewaxing bed and 10.0 for the post-treat bed. The temperature in the first reactor was adjusted so that the effluent from the first reactor contained 50 ppmw nitrogen for the spindle oil feed and 105 ppmw for the spindle oil/VGO blend. The temperature in the second reactor was adjusted to yield a 356° F.+ (180°C.+) fraction comprising about 78 to 79 weight percent of the product and having a pour point of −4° F. (−20° C.). At start of run, the temperatures required to accomplish these results were 727° F. (386° C.) in the first bed and 725° F. (385° C.) in the second. At the end of run, the first catalyst required a temperature of about 728° F. (387° C.) while the second catalyst required no change. These results clearly indicate that the two catalyst system of this example resists catalyst deactivation and provides for long life coupled with high activity.

In addition, the color (yellow with a tinge of orange) and the color stability were acceptable, the latter exhibiting no more than one unit change before and after testing in accordance with ASTM D 2274.

In the following TABLE III are tabulated some of the data obtained from analyzing samples of the 180° C. (356° F.+) fractions obtained with the spindle oil and the spindle oil/VGO blend.

TABLE III

| | Spindle Oil | Spindle Oil/VGO |
|---|---|---|
| Viscosity @ 100° C. (212° F.), cst | 3.6 | 3.9 |
| Total Nitrogen, wppm | 20 | 63 |
| Sulfur, wppm | 30 | 73 |
| Bromine No., gm/100 gm | 1.5 | 1.7 |
| Yield of 180° C. (212° F.+) | 79 | 79 |

As shown in the foregoing Table III, with both feedstocks the process of the invention yielded excellent results.

As a final point, it should be noted that, as used herein, an analysis for "nitrogen" is to the nitrogen compounds in the liquid phase, and the term thus excludes, for example, any ammonia which may, also be present. As an illustration, when it was earlier indicated that one embodiment of the invention involved adjusting the hydrotreating conditions to obtain 50 ppmw nitrogen in the product, the ammonia which is produced from the denitrogenation reactions during hydrotreating is not considered as nitrogen in the product, although it is certainly present in the effluent of the hydrotreating reactor. Also, unless otherwise indicated, all references to "nitrogen" are to total nitrogen as opposed to simply the basic nitrogen compounds.

Although the invention has been described in conjunction with examples thereof and a description of its best mode, many modifications, variations, and alternatives of the invention as described will be apparent to those skilled in the art. Accordingly, it is intended to embrace within the claimed subject matter all variations, modifications, and alternatives to the invention as fall within the spirit and scope of the appended claims.

We claim:

1. A process for refining a feedstock comprising a spindle oil, said spindle oil having an intial boiling point between about 500° and 600° F. and an end point between about 850° and 950° F., comprising hydrotreating said feedstock in the presence of hydrogen and a hydrotreating catalyst under conditions of elevated temperature and pressure and, thereafter, hydrodewaxing in the presence of a hydrodewaxing catalyst and hydrogen and under conditions of elevated temperature and pressure at least a portion of the hydrotreated effluent so as to substantially reduce the pour point of a selected fraction thereof, said hydrodewaxing catalyst comprising one or more hydrogenation components on a support comprising at least 70 weight percent of an intermediate pore molecular sieve having cracking activity.

2. The process of claim 1 wherein the nitrogen content of the hydrotreated effluent is between about 50 and 115 wppm.

3. The process of claim 1 wherein the spindle oil feedstock to the hydrotreating step contains organosulfur components, which are removed to the extent of at least 97 percent after said hydrodewaxing step.

4. The process of claim 1 wherein the conditions during said hydrotreating are adjusted to maintain a substantially constant nitrogen value in the hydrotreated effluent.

5. The process of claim 1 wherein the conditions during said hydrodewaxing step are adjusted to maintain a constant pour point in said selected fraction.

6. The process of claim 1 wherein the selected fraction is a 180° C.+ (356° F.+) fraction.

7. The process of claim 1 wherein the hydrodewaxing catalyst comprises a Group VIB and Group VIII nonnoble metal components on said support.

8. The process of claim 7 wherein the selected fraction is a 180° C.+ (356° F.+) fraction having a bromine number less than about 2.5 grams per 100 grams of sample, a color stability within 1 unit according to ASTM method D 1500 before and after aging by ASTM method D 2274, a sulfur content less than about 100 wppm, a nitrogen content less than 150 wppm, a viscosity within about 1.75 centistokes as measured at 100° C. (212° F.) of the viscosity of the feedstock, and a pour point below 0° F. (−17.8° C.)

9. A process as defined in claim 1 wherein said intermediate pore molecular sieve is silicalite.

10. A process as defined in claim 1 wherein said intermediate pore molecular sieve is ZSM-5 zeolite.

11. A process as defined in claim 1 wherein said intermediate pore molecular sieve is selected from the group consisting of crystalline silicas, silicoaluminophosphates, chromosilicates, titanium aluminophosphates, titanium aluminosilicates, ferrosilicates, borosilicates, ZSM-11, ZSM-12, ZSM-23, ZSM-35, and ZSM-38.

12. A process as defined in claim 1 wherein said intermediate pore molecular sieve is a crystalline aluminosilicate zeolite.

13. A process as defined in claim 1 wherein said intermediate pore molecular sieve has a pore size between about 5 and 6 angstroms ( 0.5 and 0.6 nm.).

14. A process as defined in claim 1 wherein the selected fraction is then blended with a fuel oil having a higher pour point than said selected fraction.

15. A process as defined in claim 1 wherein said selected fraction comprises more than 65 weight percent of the hydrodewaxed product.

16. A process as defined in claim 1 wherein the hydrogenation components comprise one or more noble metals.

17. A process as defined in claim 16 wherein the noble metals are selected from the group consisting of platinum and palladium.

18. A process as defined in claim 1 wherein the product from the hydrodewaxing catalyst is denitrogenated by at least 75 percent in comparison to said feedstock.

19. A process as defined in claim 1 wherein at least 80 percent by weight of the feedstock is a spindle oil.

20. A process as defined in claim 1 wherein said intermediate pore molecular sieve is selected from the group consisting of silicates and aluminophosphates.

21. A process as defined in claim 1 wherein said feedstock consists essentially of a spindle oil.

22. A process as defined in claim 8 wherein said feedstock consists essentially of a spindle oil.

23. A process as defined in claim 9 wherein said feedstock consists essentially of a spindle oil.

24. A process as defined in claim 10 wherein said feedstock consists essentially of a spindle oil.

25. A process as defined in claim 14 wherein said feedstock consists essentially of a spindle oil.

26. A process for refining a feedstock comprising a spindle oil, said spindle oil having an initial boiling point between about 500° and 600° F. and an end point between about 850° and 950° F., comprising hydrotreating said feedstock in the presence of hydrogen and a hydrotreating catalyst under conditions of elevated temperature and pressure and, thereafter, hydrodewaxing in the presence of a hydrodewaxing catalyst and hydrogen and under conditions of elevated temperature and pressure at least a portion of the hydrotreated effluent so as to substantially reduce the pour point of the 180° C.+ (356° F.+) fraction thereof, said hydrodewaxing catalyst comprising one or more hydrogenation components on a support comprising between 70 and 90 weight percent of a crystalline intermediate pore molecular sieve having catalytic cracking activity and the balance comprising a porous refractory oxide, and said hydrotreating catalyst comprising one or more hydrogenation metal components on a support comprising a porous refractory oxide.

27. A process as defined in claim 26 wherein said hydrogenation metal components of said hydrotreating catalyst comprise a combination of a Group VIII non-noble metal component and a Group VIB metal component, and said hydrogenation components of said hydrodewaxing catalyst comprise a combination of a Group VIII non-noble metal component and a Group VIB metal component.

28. The process as defined in claim 27 wherein the nitrogen content of the hydrotreated effluent is between about 50 and 115 wppm.

29. The process as defined in claim 28 wherein the feedstock to the hydrotreating step contains organosulfur components, which are removed to the extent of at least 97 percent after said hydrodewaxing step.

30. The process as defined in claim 29 wherein the conditions during said hydrotreating are adjusted to maintain a substantially constant nitrogen value in the hydrotreated effluent.

31. The process as defined in claim 30 wherein the conditions during said hydrodewaxing step are adjusted to maintain a substantially constant pour point in said 180° C.+ (356° F.+) fraction.

32. The process as defined in claim 30 wherein the hydrodewaxing catalyst comprises nickel and tungsten components on said support.

33. The process as defined in claim 30 wherein the 180° C.+ (356° F.+) fraction of the product from said hydrodewaxing step has a bromine number less than about 2.5 grams per 100 grams of sample, a color stability within 1 unit according to ASTM method D 1500 before and after aging by ASTM method D 2274, a sulfur content less than about 100 wppm, a nitrogen content less than 150 wppm, a viscosity within about 1.75 centistokes as measured at 100° C. (212° F.) of the viscosity of the feedstock, and a pour point below 0° F. (−17.8° C.)

34. A process as defined in claim 33 wherein said intermediate pore molecular sieve is silicalite.

35. A process as defined in claim 27 wherein said intermediate pore molecular sieve is ZSM-5 zeolite.

36. A process as defined in claim 27 wherein said intermediate pore molecular sieve is selected from the group consisting of crystalline silicas, silicoaluminophosphates, chromosilicates, titanium aluminophosphates, titanium aluminosilicates, ferrosilicates, borosilicates, ZSM-11, ZSM-12, ZSM-23, ZSM-35, and ZSM-38.

37. A process as defined in claim 33 wherein said intermediate pore molecular sieve is a crystalline aluminosilicate zeolite.

38. A process as defined in claim 30 wherein said intermediate pore molecular sieve has a pore size between about 5 and 6 angstroms ( 0.5 and 0.6 nm.).

39. A process as defined in claim 33 wherein said hydrogenation components on said hydrodewaxing catalyst comprise nickel and tungsten components.

40. A process as defined in claim 39 wherein said intermediate pore molecular sieve is either ZSM-5 zeolite or silicalite.

41. A process as defined in claim 40 wherein the viscosity of said 180° C.+ (356° F.+) fraction is within 1.5 centistokes, as measured at 100° C. (212° F.), of the viscosity of the feedstock to the hydrotreating step.

42. A process as defined in claim 41 wherein said hydrotreating catalyst comprises nickel, molybdenum, and phosphorus components on a support comprising gamma alumina.

43. A process as defined in claim 42 wherein said hydrotreating catalyst has a surface area of at least 150 m2/gm, a mode pore diameter between about 75 and 90 angstroms, and a pore size distribution wherein at least about 70 percent of the pore volume is in pores of diameter in the range from 20 angstroms (2 nm.) below to 20 angstroms (2 nm.) above the mode pore diameter.

44. A process as defined in claim 43 wherein the viscosity of said 180° C.+(356° F.+) fraction after hydrodewaxing is within 0.5 centistokes, as measured at 100° C. (212° F.), of the viscosity of the feedstock to the hydrotreating step.

45. A process as defined in claim 43 wherein said hydrotreating catalyst is of quadralobal shape.

46. A process as defined in claim 27 wherein the 180° C.+ (356° F.+) fraction, after said hydrodewaxing, is then blended with a fuel oil of higher pour point and higher sulfur content.

47. A process as defined in claim 29 wherein the 180° C.+ (356° F.+) fraction, after said hydrodewaxing, is then blended with a fuel oil of higher pour point and higher sulfur content.

48. A process as defined in claim 34 wherein the 180° C.+ (356° F.+) fraction, after said hydrodewaxing, is then blended with a fuel oil of higher pour point and higher sulfur and nitrogen contents.

49. A process as defined in claim 35 wherein the 180° C.+ (356° F.+) fraction, after said hydrodewaxing, is then blended with a fuel oil of higher pour point and higher sulfur content.

50. A process as defined in claim 27 wherein said intermediate pore molecular sieve is selected from the group consisting of silicates and aluminophosphates.

51. A process as defined in claim 27 wherein said feedstock consists essentially of a spindle oil.

52. A process as defined in claim 29 wherein said feedstock consists essentially of a spindle oil.

53. A process as defined in claim 39 wherein said feedstock consists essentially of a spindle oil.

54. A process as defined in claim 42 wherein said feedstock consists essentially of a spindle oil.

55. A process as defined in claim 44 wherein said feedstock consists essentially of a spindle oil.

56. A process as defined in claim 48 wherein said feedstock consists essentially of a spindle oil.

57. A process as defined in claim 49 wherein said feedstock consists essentially of a spindle oil.

58. A process for refining a feedstock comprising spindle oil, said spindle oil having an initial boiling point between about 500° and 600° F. and an end point between about 850° and 950° F., comprising hydrotreating said feedstock in the presence of hydrogen and a first hydrotreating catalyst under conditions, of elevated temperature and pressure and, thereafter, hydrodewaxing in the presence of a hydrodewaxing catalyst and hydrogen and under conditions of elevated temperature and pressure at least a portion of the hydrotreated effluent so as to substantially reduce the pour point of the 180° C.+ (356° F.+) fraction thereof, and thereafter, hydrotreating the entire effluent from the hydrodewaxing catalyst in the presence of a second hydrotreating catalyst and hydrogen under conditions of elevated temperature and pressure, said hydrodewaxing catalyst comprising one or more hydrogenation.

components on a support comprising between 70 and 90 weight percent of a crystalline intermediate pore molecular sieve and the balance comprising a porous refractory oxide, and both of said hydrotreating catalysts comprising one or more hydrogenation metal components on a support comprising a porous refractory oxide.

59. A process as defined in claim 58 wherein the entire effluent from the first hydrotreating step is passed to the hydrodewaxing step.

60. A process as defined in claim 58 wherein each of said catalysts is arranged in a reactor vessel wherein all reactants pass therethrough in a downflow arrangement.

61. A process as defined in claim 59 wherein the 180° C.+ (356° F.+) fraction, after said hydrodewaxing and subsequent hydrotreating, is then blended with a fuel oil of higher pour point and higher sulfur and nitrogen contents.

62. A process as defined in claim 58 wherein said selected fraction comprises more than 75 weight percent of the product from the second hydrotreating catalyst.

63. A process as defined in claim 58 wherein the product from the second hydrotreating step is denitrogenated by at least 75 percent in comparison to said feedstock.

64. A process as defined in claim 58 wherein the product from the second hydrotreating step is denitrogenated by at least 90 percent in comparison to said feedstock.

65. A process as defined in claim 59 wherein said feedstock consists essentially of a spindle oil.

66. A process as defined in claim 61 wherein said feedstock consists essentially of a spindle oil.

67. A process for refining a feedstock comprising a spindle oil, said spindle oil having an initial boiling point between about 500° and 600° F. and an end point between about 850° and 950° F., comprising hydrotreating said feedstock in the presence of hydrogen and a hydrotreating catalyst under conditions of elevated temperature and pressure and, thereafter, hydrodewaxing in the presence of a hydrodewaxing catalyst and hydrogen and under conditions of elevated temperature and pressure at least a portion of the hydrotreated effluent so as to substantially reduce the pour point of a selected fraction thereof, said hydrodewaxing catalyst comprising one or more hydrogenation components on a support comprising at least 70 weight percent of a molecular sieve having pore openings defined by 10-membered rings of oxygen atoms and having cracking activity.

68. A process as defined in claim 67 wherein at least 80 percent by weight of the feedstock is a spindle oil.

69. A process for reducing the pour point of a fuel oil with minimum degradation of the viscosity thereof, said process comprising:

(1) hydrotreating a sulfur, nitrogen, and hydrocarbon-containing feedstock having an initial boiling point between about 500° and 600° F. and an end point between about 850° and 950° F. in the presence of a particulate hydrotreating catalyst comprising hydrogenation components on a porous refractory oxide support under conditions of elevated temperature and pressure and the presence of hydrogen so as to decrease the sulfur and nitrogen content of said feedstock;

(2) hydrodewaxing at least a portion of the hydrotreated feedstock in the presence of a particulate hydrodewaxing catalyst under conditions of elevated temperature and pressure and the presence of hydrogen so as to produce a hydrocarbon fraction of lower pour point than said fuel oil, said hydrodewaxing catalyst comprising one or more hydrogenation components on a support comprising at least 70 weight percent of an intermediate pore molecular sieve having cracking activity, and said fraction having a viscosity within about 1.75 centistokes, as measured at 212° F., of the viscosity of the feedstock;

(3) hydrotreating the entire effluent from said hydrodewaxing in the presence of hydrogen and under conditions of elevated temperature and pressure and in the presence of a particulate hydrotreating catalyst comprising one or more hydrogenation components on a porous refractory oxide support;

(4) recovering said fraction from the product of said hydrotreating in step (3); and (5) blending said fraction with a fuel oil of higher pour point so as to reduce the pour point thereof while not substantially changing the viscosity of the fuel oil.

70. A prrocess as defined in claim 69 wherein the hydrotreating catalysts in steps (1) and (3) consist essentially of hydrogenation components on a non-cracking support.

71. The process of claim 70 wherein the conditions during said hydrotreating in step (1) are adjusted to maintain a substantially constant nitrogen value in said hydrotreated feedstock and the conditions during said hydrodewaxing step are adjusted to maintain a constant pour point in said fraction in step (2).

72. A process as defined in claim 71 wherein said hydrogenation components of said hydrotreating catalyst comprise a combination of a Group VIII non-noble metal component and a Group VIB metal component, and said hydrogenation components of said hydrodewaxing catalyst comprise a combination of a Group VIII non-noble metal component and a Group VIB metal component.

73. A process as defined in claim 72 wherein the entire effluent from the hydrotreating step (1) is passed to the hydrodewaxing step (2).

74. A process as defined in claim 73 wherein said intermediate pore molecular sieve is selected from the group consisting of crystalline silicas, silicoaluminophosphates, chromosilicates, titanium aluminophosphates, titanium aluminosilicates, ferrosilicates, borosilicates, ZSM-11, ZSM-12, ZSM-23, ZSM-35, and ZSM-38.

75. A process as defined in claim 73 wherein said intermediate pore molecular sieve is a crystalline aluminosilicate zeolite.

76. A process as defined in claim 73 wherein said intermediate pore molecular sieve is ZSM-5 zeolite.

77. A process as defined in claim 73 wherein said intermediate pore molecular sieve is silicalite.

78. A process as defined in claim 73 wherein the product from the second hydrotreating catalyst is denitrogenated by at least 75 percent in comparison to said feedstock entering step (1).

79. A process as defined in claim 78 wherein the fraction recovered in step (4) contains less nitrogen and sulfur than said fuel oil, so that, in step (5), the blend of said fraction and fuel oil contains sulfur and nitrogen in a lower concentration than said fuel oil.

80. A process as defined in claim 79 wherein the viscosity of said recovered fraction in step (4) is within 1.5 centistokes, as measured at 100° C. (212° F.), of the viscosity of the feedstock entering step (1).

81. A process as defined in claim 80 wherein said fraction comprises more than 65 weight percent of the hydrocarbons from said hydrodewaxing step (2).

82. A process as defined in claim 81 wherein said intermediate pore molecular sieve is silicalite.

83. A process as defined in claim 81 wherein said intermediate pore molecular sieve is ZSM-5 zeolite.

84. A process as defined in claim 81 wherein said intermediate pore molecular sieve has a pore size between about 5 and 6 angstroms (0.5 and 0.6 nm.).

85. A process as defined in claim 81 wherein said intermediate pore molecular sieve is either ZSM-5 zeolite or silicalite.

86. The process of claim 85 wherein the recovered fraction in step (4) has a bromine number less than about 2.5 grams per 100 grams of sample, a color stability within 1 unit according to ASTM method D 1500 before and after aging by ASTM method D 2274, a sulfur content less than about 100 wppm, a nitrogen content less than 150 wppm, and a pour point below 0° F. (−17.8° C.).

87. A process as defined in claim 86 wherein said fraction comprises more than 75 weight percent of the hydrocarbons produced in the hydrotreating step (3).

88. A process as defined in claim 87 wherein the product from the hydrotreating step (3) is denitrogenated by at least 90 percent in comparison to said feedstock entering step (1).

89. A process as defined in claim 88 wherein each of said catalysts is arranged in a reactor vessel wherein all reactants pass therethrough in a downflow arrangement.

90. A process as defined in claim 88 wherein both of said hydrotreating catalysts have a surface area of at least 150 m2/gm, a mode pore diameter between about 75 and 90 angstroms, and a pore size distribution wherein at least about 70 percent of the pore volume is in pores of diameter in the range from 20 angstroms (2 nm.) below to 20 angstroms (2 nm.) above the mode pore diameter.

91. A process as defined in claim 90 wherein said hydrogenation components on said hydrodewaxing catalyst comprise nickel and tungsten components.

92. The process of claim 91 wherein the fraction is a 180° C.+ (356° F.+) fraction.

93. A process as defined in claim 92 wherein said intermediate pore molecular sieve is silicalite.

94. The process as defined in claim 93 wherein the feedstock to hydrotreating step (1) contains organosulfur components, which are removed to the extent of at least 97 percent after said hydrodewaxing step (2).

95. A process as defined in claim 94 wherein the viscosity of said 180° C.+ (356° F.+) fraction after hydrodewaxing is within 0.5 centistokes, as measured at 100° C. (212° F.), of the feedstock to the hydrotreating step.

96. The process of claim 95 wherein the nitrogen content of the hydrotreated feedstock from step (1) is between about 50 and 115 wppm.

97. The process of claim 95 wherein the conditions during said hydrotreating in step (1) are such as to maintain a value of 50 wppm nitrogen in the hydrotreated feedstock.

98. The process of claim 97 wherein the entire effluent hydrotreated in step (3) initially contains mercaptans and olefins but said hydrotreating in step (3) substantially reduces the amounts thereof.

99. The process of claim 98 wherein the hydrogenation components on both of said hydrotreating catalysts comprise nickel and molybdenum.

100. The process of claim 95 wherein the entire effluent hydrotreated in step (3) initially contains mercaptans but said hydrotreating in step (3) substantially reduces the amount thereof.

101. The process of claim 100 wherein the hydrogenation components on both of said hydrotreating catalysts comprise nickel and molybdenum.

102. The process as defined in claim 101 wherein said intermediate pore molecular sieve comprises 70 to 90 percent by weight of the support of the hydrodewaxing catalyst.

103. The process as defined in claim 96 wherein said intermediate pore molecular sieve comprises 75 to 90 percent by weight of the support of the hydrodewaxing catalyst.

104. The process of claim 103 wherein the hydrogenation components on both of said hydrotreating catalysts comprise nickel and molybdenum.

105. The process as defined in claim 99 wherein said intermediate pore molecular sieve comprises 75 to 90 percent by weight of the support of the hydrodewaxing catalyst.

106. A process as defined in claim 104 wherein both of said hydrotreating catalysts are of quadralobal shape.

107. A process as defined in claim 105 wherein both of said hydrotreating catalysts are of quadralobal shape.

108. A process as defined in claim 106 wherein each of said catalysts is arranged in a reactor vessel wherein all reactants pass therethrough in a downflow arrangement.

109. A process as defined in claim 107 wherein each of said catalysts is arranged in a reactor vessel wherein all reactants pass therethrough in a downflow arrangement.

110. A process for refining a feedstock comprising a spindle oil, said spindle oil having an initial boiling point between about 500° and 600° F. and an end point between about 850° and 950° F., comprising hydrotreating said feedstock in the presence of hydrogen and a hydrotreating catalyst under conditions of elevated temperature and pressure and, thereafter, hydrodewaxing in the presence of a hydrodewaxing catalyst and hydrogen and under hydrodewaxing conditions of elevated temperature and pressure, said hydrodewaxing catalyst comprising one or more hydrogenation components on a support comprising at least 70 weight percent of an intermediate pore molecular sieve having cracking activity, and said hydrodewaxing conditions producing at least one fraction of substantially reduced pour point in comparison to said feedstock but of viscosity within about 1.75 centistokes, as measured at 212° F., of the viscosity of the feedstock.

111. A process as defined in claim 110 wherein said fraction comprises at least 65 percent by weight of the hydrodewaxed product.

112. A process as defined in claim 111 wherein said fraction after hydrodewaxing is hydrotreated.

113. A process as defined in claim 110 wherein said feedstock consists essentially of a spindle oil.

114. A process as defined in claim 112 wherein said feedstock consists essentially of a spindle oil.

115. A process as defined in claim 110 wherein, after said hydrodewaxing, said fraction is then blended with a fuel oil of higher pour point and higher sulfur and nitrogen contents.

116. A process as defined in claim 114 wherein said fraction, after said hydrodewaxing and subsequent hydrotreating, is then blended with a fuel oil of higher pour point and higher sulfur and nitrogen contents.

* * * * *